United States Patent [19]

Freudenthal et al.

[11] Patent Number: 4,512,436

[45] Date of Patent: Apr. 23, 1985

[54] PLATFORM ROTATING MECHANISM FOR AERIAL DEVICES

[75] Inventors: Frank D. Freudenthal, Andrew County; Carl M. Anderson, Buchanan County, both of Mo.

[73] Assignee: Altec Industries, Inc., Birmingham, Ala.

[21] Appl. No.: 510,062

[22] Filed: Jul. 1, 1983

[51] Int. Cl.[3] ..... B66F 11/04

[52] U.S. Cl. ..... 182/2

[58] Field of Search ..... 182/2, 66, 141, 148

[56] References Cited

U.S. PATENT DOCUMENTS

| | | | |
|---|---|---|---|
| 655,923 | 8/1900 | Dutton | 182/2 |
| 2,026,535 | 1/1936 | Hooker | 182/66 |
| 3,056,510 | 10/1962 | Garnett | 182/2 |
| 3,841,436 | 10/1974 | Grove | 182/2 |
| 4,271,926 | 6/1981 | Cullity | 182/2 |

OTHER PUBLICATIONS

"Platform rotator", figure 15, copy submitted by applicant.

"Pitman Manufacturing Co.", Canada copy submitted by applicant.

*Primary Examiner*—Reinaldo P. Machado

*Attorney, Agent, or Firm*—Kokjer, Kircher, Bradley, Wharton, Bowman & Johnson

[57] ABSTRACT

A mechanism for rotating an aerial platform carried on the upper end of a truck mounted aerial boom assembly. The upper boom tip carries a rotatable platform pin to which a rigid beam is secured to extend forwardly beyond the boom tip. The platform is a bucket mounted on the forward end of the beam for rotation about a vertical axis displaced well forwardly from the axis of the platform pin. A hydraulic cylinder rotates the bucket about its vertical rotational axis through a 90° arc between a side hung position alongside the upper boom tip and an end hung position beyond the end of the boom tip. A spring loaded locking pin locks the bucket in the end hung position and provides a safety device that prevents the bucket from being rotated against a material handling jib that may be used in the side hung position of the bucket.

21 Claims, 7 Drawing Figures

PLATFORM ROTATING MECHANISM FOR AERIAL DEVICES

BACKGROUND AND SUMMARY OF THE INVENTION

This invention relates generally to vehicle mounted aerial devices and more particularly to a platform rotating mechanism which serves to rotate an aerial platform between a position to the side of the boom and a position at the end of the boom.

Vehicle mounted aerial devices have long been used for a variety of applications such as performing work on utility poles and overhead power or telephone lines. The aerial device normally includes a multiple section boom which can either be articulating or extensible and retractable in telescoping fashion. The top end of the upper boom section is equipped with a personnel carrying device which is referred to in the industry as a "platform" and which can be a bucket, basket, stand or similar device. More than one platform or bucket can be provided, and the bucket can be large enough to carry either one or two workers.

It is often desirable to install a material handling jib on the upper boom tip. The jib essentially forms an extension of the upper boom, and it can usually be tilted up or down by a hydraulic cylinder. The material handling jib can be used to handle various materials. One common use is in combination with a hydraulic winch and cable to lift heavy objects such as transformers and the like to the upper end of the boom. In this type of arrangement, the winch cable is passed over a pulley which is carried on the free outer end of the jib.

If a material handling jib is employed, the bucket or buckets must be mounted on the side of the upper boom tip in order to provide room for installation of the jib. If a jib is not used, the bucket can be an end hung bucket mounted on the end of the upper boom. Both the side hung and end hung buckets have certain advantages that are not enjoyed by the other. As previously indicated, the side hung buckets permit the use of a material handling jib. The end hung bucket presents a narrower profile and a more compact arrangement than side hung buckets. Also, the end hung bucket provides more horizontal reach due to its location beyond the end of the upper boom tip.

Devices known as platform rotators have been used with side hung buckets to overcome some of their disadvantages. The platform rotators permit the side hung buckets to be rotated to a limited extent to the front and to the rear from their normal side hung positions. This permits a material handling jib to be used and allows the workers in the buckets to be positioned in various ways to perform various tasks. However, in the platform rotators that have been proposed in the past, the vertical axis about which the bucket rotates is directly or nearly directly in line with the platform pin which mounts the bucket on the upper boom. Due to the location of the vertical axis of rotation in line with or nearly in line with the platform pin axis, the rotation of the buckets is restricted and they cannot swing beyond the end of the upper boom to the position occupied by an end hung bucket. Consequently, side hung buckets have not been able to assume as compact a position as end hung buckets and have not been able to provide as narrow a profile, even when equipped with platform rotators.

In aerial devices having platform rotators, positive leveling systems are used to maintain the bucket in a vertical attitude regardless of the position assumed by the boom assembly. The leveling system most commonly used is a cable and sheave system which acts to maintain a constant orientation of the platform pin on which the platform is mounted. By maintaining the platform pin in a preselected orientation relative to the ground, the floor of the bucket can be maintained in the desired horizontal position at all times as the boom rotates, extends, articulates or pivots up and down. Platform leveling can be achieved with other types of leveling systems such as master and slave cylinders or parallelogram type mechanical linkages. Passive systems which rely on the influence of gravity to maintain the bucket in a vertical orientation can be used on some aerial devices but are inapplicable to the machine of the present invention and other machines having platform rotators.

SUMMARY OF THE INVENTION

The present invention is directed to an improved platform rotator for aerial devices and has, as its principal goal, the provision of a platform rotating mechanism which is capable of rotating an aerial platform from a side hung position to the position occupied by an end hung platform located fully to the front of the upper boom. In accordance with the invention, the vertical axis about which the side hung bucket rotates is displaced well forwardly from the axis of the platform pin and is actually located beyond the upper boom tip. This permits the bucket to be rotated through a full 90° arc from the side hung position to what is essentially an end hung position beyond the end of the boom. The advantages of both side hung and end hung platforms are thus enjoyed. A material handling jib can be used with the bucket or buckets in the side hung position, and the end hung location provides the advantages of added reach and a compact configuration.

It is another important feature of the invention that a relatively narrow profile is presented when the bucket is in the side hung position and an even narrower profile is presented in the end hung position of the bucket. The relatively small width dimension of the bucket is oriented parallel to the platform pin when the bucket is in the side hung position, so the bucket projects to the side of the boom only to the extent of its width dimension. When the bucket is rotated to the end hung position, its length dimension extends across the boom in a manner similar to conventional end hung buckets.

A further object of the invention is to provide a platform rotating mechanism which accommodates buckets or other platforms on both sides of the upper boom.

It is yet another object of the invention to provide, in a platform rotating mechanism of the character described, reliable means for releasably holding the platform in the end hung position. A mechanical locking device can be used, or a pilot operated holding valve on the platform rotation cylinder can be provided to perform the same function.

An additional object of the invention is to provide a platform rotating mechanism in which the platform is prevented from being rotated far enough to collide with a material handling jib mounted on the upper boom tip. A stop arrangement makes it necessary to intentionally release a locking pin before the platform can be rotated against the jib, and the safety of the machine is enhanced accordingly.

A still further object of the invention is to provide a platform rotating mechanism in which the platform rotation can be conveniently controlled from the platform and can be carried out either manually or by hydraulic or electric power. Although a hydraulic cylinder is disclosed as the power source for rotating the bucket, other power systems and manually actuated drive systems can be used.

Yet another object of the invention is to provide a platform rotating mechanism which can be installed on a wide variety of both extensible and articulating booms (both overcenter and non-overcenter types), which is simple and economical to construct and maintain, and which is safe and reliable in operation.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith and in which like reference numerals are used to indicate like parts in the various views.

Figure 1:
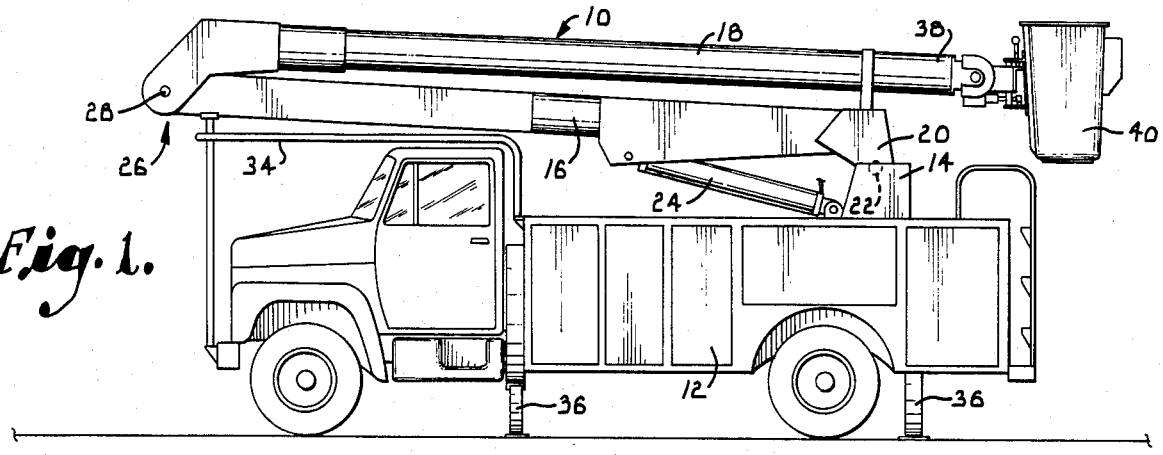
FIG. 1 is a side elevational view of a truck mounted aerial device equipped with a platform rotating mechanism constructed according to a preferred embodiment of the present invention, with the boom of the aerial device retracted to a storage position.

Referring now to the drawings in more detail and initially to FIG. 1, numeral 10 generally designates an aerial device which is mounted in the bed of a truck 12. The aerial device 10 includes a turntable 14 which is mounted for rotation on top of a stationary pedestal (not shown) located in the truck bed. An articulating boom assembly includes a lower boom 16 and an upper boom 18. The bottom end of the lower boom 16 carries a bracket 20. A lower boom pin 22 pivotally connects the turntable 14 to the bracket 20, thus permitting the boom assembly to be pivoted up and down about the horizontal axis of pin 22. A hydraulic cylinder 24 has its base end pivoted to the turntable 14 and its rod end pivoted to the lower boom 16 in order to raise and lower the boom assembly about the lower boom pin 22.

Figure 2:
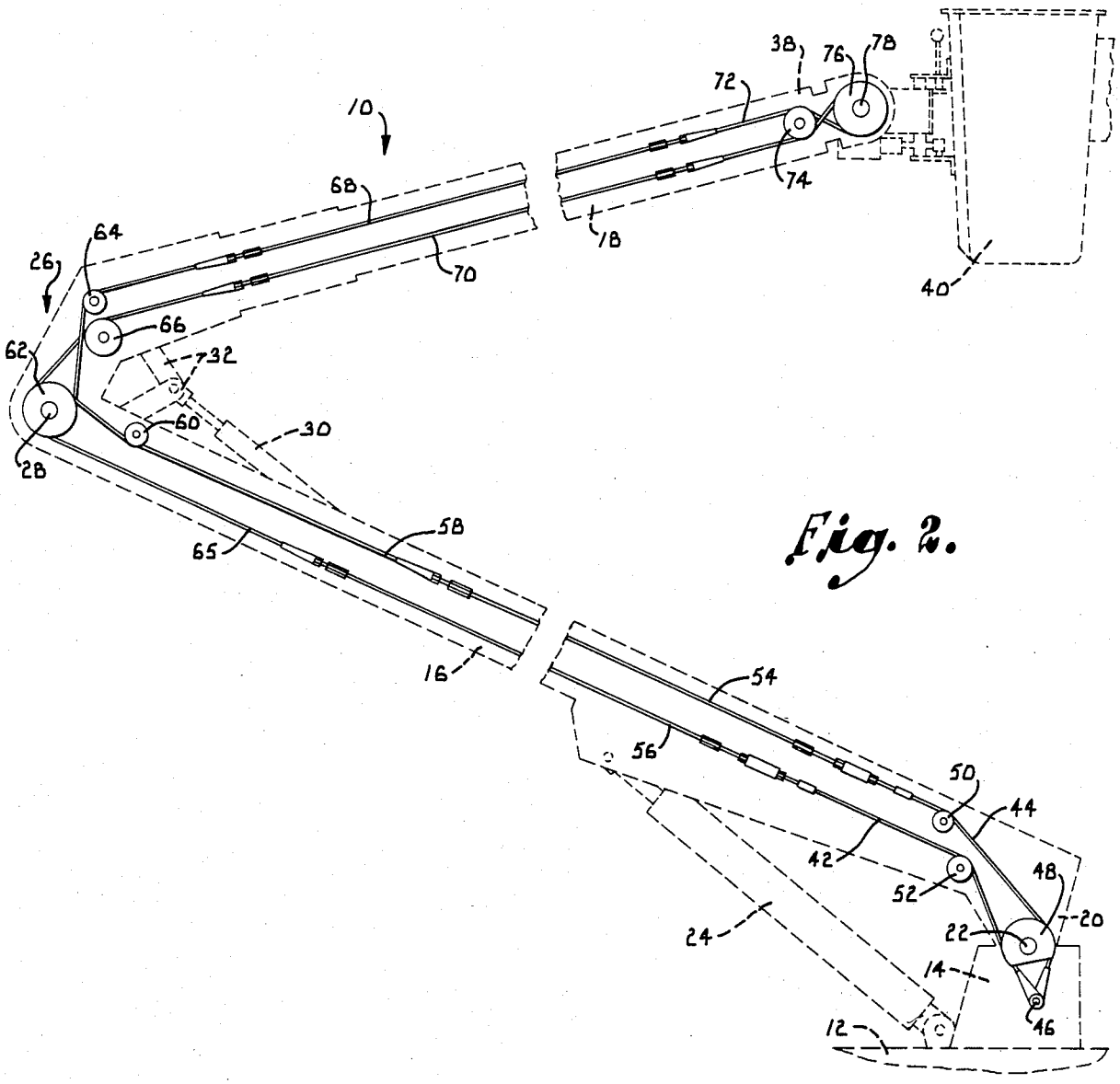
FIG. 2 is a side elevational view showing the sheave and cable leveling system of the aerial device, with the boom assembly shown in dashed lines in an extended working position and the break lines indicating continuous length of the boom sections and insulated rods.

The top end of the lower boom 16 is pivotally connected with the lower end of the upper boom 18 at an elbow 26 having a horizontal elbow pin 28. As best shown in FIG. 2, an upper boom cylinder 30 has its base end pivotally connected with the lower boom 16 and its rod end connected with an upper boom drive mechanism 32 located at the elbow 26. Extension of cylinder 30 raises the upper boom 18 about the elbow pin 28, and retraction of the cylinder lowers the upper boom about pin 28.

The truck 12 may be equipped with a rack 34 on which the lower boom 16 rests when the boom assembly is in the storage position shown in FIG. 1. The truck is also equipped with outriggers 36 which provide stability when the aerial device 10 is raised and in use. The free end of the upper boom 18 is known as the upper boom tip and is designated by numeral 38. Mounted on the upper boom tip 38 is an aerial bucket 40 in which one or more workers are carried when the aerial device is in use. It should be understood that the bucket 40 can be replaced by a basket, a stand, or any other personnel carrying device, referred to in the industry as a "platform".

Referring now to FIG. 2, the bucket 40 is maintained in a vertical attitude at all times by a sheave and cable leveling system which extends within the boom assembly. The leveling system includes a pair of lower cables 42 and 44 having their lower ends fixed to the turntable 14 at a common point 46. Cables 42 and 44 pass below and above a sheave 48. The cables 42 and 44 are also passed over respective sheaves 50 and 52 and are connected at their upper ends with respective insulated rods 54 and 56. The top end of rod 54 connects with a cable 58 which is passed beneath a sheave 60, around another sheave 62 mounted on the elbow pin 28 and over an additional sheave 64. The top end of the other rod 56 connects with a cable 65 passed beneath sheave 62 and over another sheave 66. The top ends of cables 58 and 65 connect with respective insulated rods 68 and 70. The opposite ends of a cable 72 are connected with the top ends of rods 68 and 70 located in the upper boom 18. Cable 72 is passed above and below a split sheave 74 and around a larger sheave 76 which is mounted on the upper boom tip 38 on a horizontal platform pin 78. The platform 40 is mounted on the platform pin 78 in a manner that will be explained more fully.

The components of the sheave and cable leveling system extend within the booms 16 and 18 and function to maintain the platform pin 78 in a constant orientation relative to the ground, regardless of the position assumed by the boom assembly. This maintains the floor of the bucket 40 in a horizontal position at all times. The insulated rods 54, 56, 68 and 70 are not always necessary but are provided when the upper and lower boom are insulated.

As thus far described, the boom assembly and leveling system are conventional.

Referring now to FIGS. 3–6, the upper sheave 76 (see FIG. 2) of the leveling system is mounted for rotation on a bracket 80 which extends beyond the upper boom tip 38. The sheave 76 is enclosed by a cover 82. The platform pin 78 extends through cover 82 and is keyed or otherwise rigidly connected with the upper sheave 76. Pin 78 extends horizontally and is supported by a sleeve 84 to turn about a horizontal axis coincident with its own axis. Sleeve 84 is mounted on bracket 80 so that the platform pin 78 can turn with respect to the upper boom 18. Bushings 86 and 88 surround the opposite end portions of the platform pin 78 and are covered on the ends by bolted covers **86*a* and 88*a***.

Figure 6:
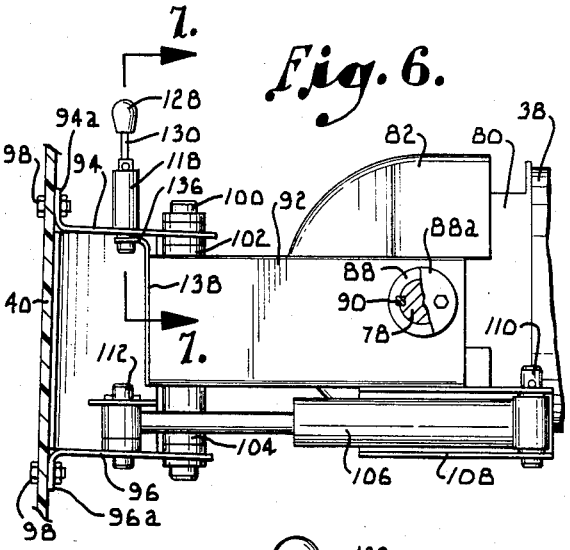
FIG. 6 is a fragmentary sectional view on an enlarged scale taken generally along line 6—6 of FIG. 4 in the direction of the arrows.

As best shown in FIG. 6, a key 90 connects bushing 88 to the platform pin 78 for rotation therewith. One end of a horizontal beam 92 is welded or otherwise secured to bushing 88 and extends forwardly therefrom well beyond the upper boom tip and the sheave cover 82. The opposite or forward end of beam 92 is received between upper and lower bracket plates 94 and 96. The bracket plates 94 and 96 have flanges 94*a* and 96*a* which are secured by bolts 98 to one of the side walls of the bucket 40.

The bucket 40 is connected with the forward end of beam 92 for rotation about a vertical axis provided by a pin 100. The pin 100 extends through bearings 102 and 104 and serves to pin the front end portion of beam 92 between the brackets 94 and 96. The bucket 40 can be rotated about the axis of pin 100 between the side hung position shown in FIG. 3 and the end hung position shown in FIG. 4, which amounts to a 90° arc of rotation. It should be understood that the arc of rotation of the bucket can be somewhat more than or less than 90°.

A hydraulic cylinder 106 rotates the bucket about its axis of rotation. The base end of cylinder 106 is pivotally connected to a bracket 108 secured to the bottom of beam 92. A vertical pin 110 connects the cylinder with the bracket 108. The opposite or rod end of cylinder 106 is connected to the lower bracket 96 by a vertical pivot pin 112. When cylinder 106 is fully retracted, bucket 40 is in the side hung position shown in FIG. 3. Conversely, when the cylinder is fully extended, the bucket is rotated through a 90° arc to the end hung position shown in FIG. 4.

The cylinder 106 is controlled in a conventional manner by one section of a three section hydraulic valve package 114 mounted on the outside of one of the side walls of bucket 40. The three sections of the valve package 114 have associated actuating handles 116 which are readily accessible to a worker stationed in the bucket 40. By properly manipulating one of the control handles 116, cylinder 106 can be extended and retracted to rotate bucket 40 to the desired position. The other two handles 116 control a jib and winch which will subsequently be described.

Figure 7:
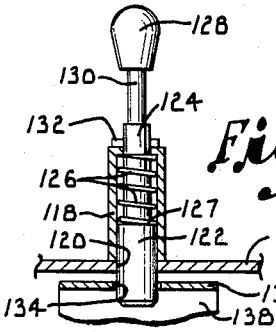
FIG. 7 is a fragmentary sectional view on an enlarged scale taken generally along line 7—7 of FIG. 6 in the direction of the arrows.

With particular reference now to FIG. 7, a vertical sleeve 118 is welded or otherwise secured on top of bracket 94 with the hollow interior of the sleeve in registration with an opening 120 formed through the bracket 94. Received in sleeve 118 for up and down sliding movement is a spring loaded locking pin 122 which normally extends through opening 120 well below bracket 94. The locking pin 122 has a reduced shaft 124 which is encircled by a compression spring 126. The bottom end of spring 126 contacts an annular shoulder 127 formed on pin 122 where the reduced shaft 124 begins. The top end of the spring contacts the top end of sleeve 118 to thereby continuously bias pin 122 downwardly toward the locking position shown in FIG. 7. A knob 128 is connected with shaft 124 by a rod 130 which is threaded into the shaft. The knob 128 projects well above bracket plate 94 and is thus conveniently accessible to a worker stationed in the bucket 40. By pulling upwardly on knob 128, pin 122 can be raised to a release position. A roll pin 132 extends through the top portion of barrel 124 and contacts the top of sleeve 118 to limit the downward movement of pin 122 and the connected parts.

Figure 4:
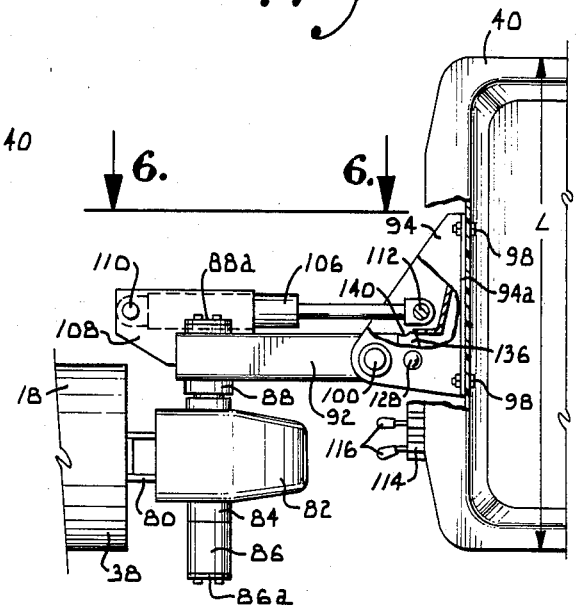
FIG. 4 is a fragmentary top plan view similar to that of FIG. 3, but showing the bucket rotated to the end hung position.
Figure 5:
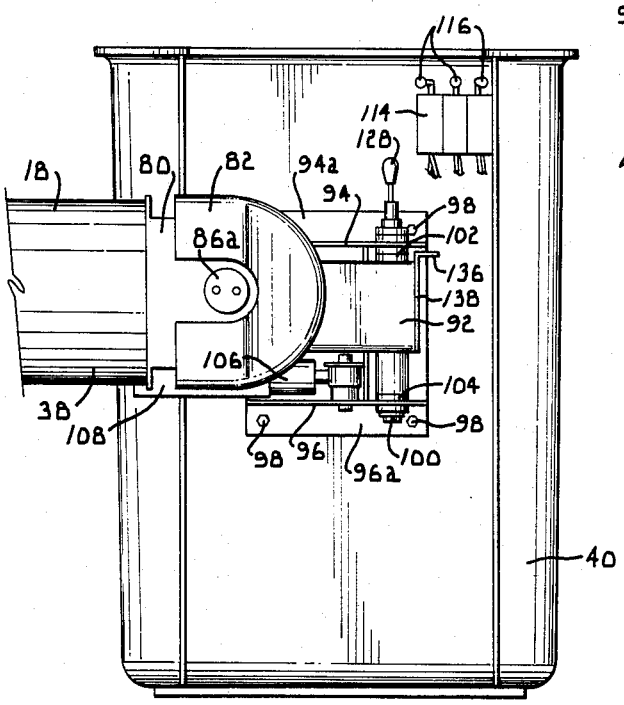
FIG. 5 is a fragmentary side elevational view taken generally along line 5—5 of FIG. 3 in the direction of the arrows.

Pin 122 cooperates with a notch 134 which is formed in the edge of a horizontal flange 136 turned forwardly from the top end of a plate 138. The plate 138 is secured to the forward end of beam 92. As best shown in FIG. 4, one side of flange 136 is provided with a smaller notch 140 having a size to receive the locking pin 122. The notched flange 136 serves as a keeper plate which holds the locking pin, as will be explained more fully. A pilot operated holding valve (not shown) for cylinder 108 can be used in place of the pin and notch locking arrangement.

Figure 3:
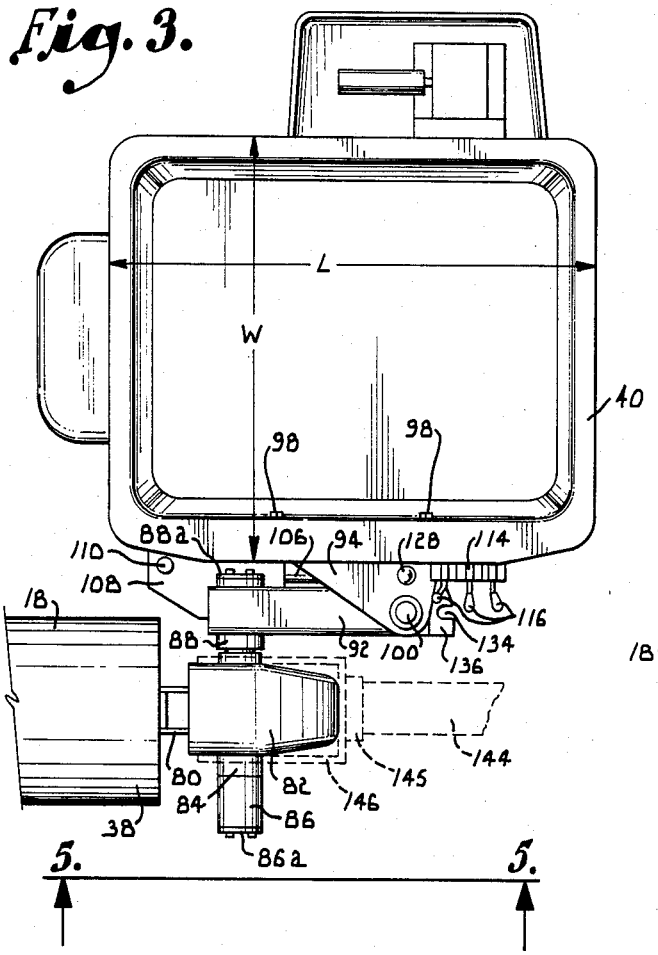
FIG. 3 is a fragmentary top plan view on an enlarged scale of the upper boom tip and bucket of the aerial device, with the bucket in the side hung position.

The bucket 40 is constructed in a conventional manner and is preferably fiberglass or another insulating material. As best shown in FIG. 3, the bucket 40 has a length dimension L somewhat greater than its width dimension W. When the bucket 40 is in the side hung position, the length dimension L is oriented perpendicular to the platform pin 78, and the width dimension W is oriented parallel with the platform pin. When the bucket is in the end hung position shown in FIG. 4, the length dimension L is oriented parallel with pin 78 and the width dimension W is perpendicular to the platform pin. It is to be understood that the present invention is useful with platforms or buckets having virtually any configuration.

In operation of the aerial device, the lower boom cylinder 24 and the upper boom cylinder 30 are extended and retracted to raise and lower the boom assembly and the man or men stationed in the working basket 40. The boom assembly can also be rotated by rotating the turntable 14 by means of a hydraulic motor (not shown) or another type of motor. At all positions of the boom, the leveling system maintains the platform pin 78 in a preselected position relative to the ground in order to maintain the floor of bucket 40 in a horizontal position at all times. As the boom moves between various positions, the leveling system causes the platform pin 78 to turn relative to the boom. The rigid beam 92 rotates with the platform pin, as does the bucket mounted on the forward end of the beam.

When cylinder 106 is fully retracted, bucket 40 is in the side hung position shown in FIG. 3, and a worker stationed in the bucket can perform a variety of tasks. Since the bucket 40 projects to the side of boom 38 only to the extent of its relatively small width dimension W, the bucket presents a relatively narrow profile in the side hung position.

When the bucket is in the side hung position, a material handling jib 144 (FIG. 3) can be installed in a short sleeve 145 which is secured to a bracket 146 mounted on the end of the upper boom tip 38. The jib 144 can be removed from the sleeve 145 When installed, the jib essentially forms a continuation of the upper boom 18. Normally, the jib 144 can be tilted up or down by a hydraulic cylinder (not shown), and it is often used in combination with a hydraulic winch (not shown) mounted on the upper boom tip 38. The winch has a cable passed around a pulley carried on the outer end of jib 144 so that heavy objects can be lifted to the top end of the boom. In the side hung position, the bucket 40 does not interfere with the material handling jib 144.

When the jib 144 is removed, cylinder 106 can be extended to pivot the bucket through a 90° arc to the end hung position shown in FIG. 4. In this position, the bucket is located well forwardly of the upper boom tip 38, and a worker stationed in the bucket can perform various tasks. It is noted that a significant portion of the length dimension L of the bucket is located forwardly of the upper boom 18, so that the bucket presents an even narrower profile in the end hung position (FIG. 4) than in the side hung position (FIG. 3). It is also pointed out that an increased horizontal reach is provided in the end hung position because the worker or workers stationed in the bucket can reach farther beyond the end of the upper boom tip 38.

As cylinder 106 is extended to rotate the bucket from the side hung position toward the end hung position, the locking pin 122 is engaged in the side notch 140 before the bucket has been rotated far enough to contact the material handling jib 144. This stop arrangement prevents the bucket from inadvertently rotating against the jib and thus enhances the safety of the machine. When the pin 122 has entered the notch 140, it is necessary to pull upwardly on handle 128 in order to retract pin 122 above flange 136 to the release position before the pin can clear flange 136 so that rotation toward the end hung position can continue.

Pin 122 and flange 136 thus provide a stop which can be overridden or disabled only by intentionally raising pin 122 to its release position. When the bucket reaches the end hung position, handle 128 is released and pin 122 enters the end notch 134 in flange 136. The compression spring 126 maintains pin 122 in the locking position in the notch and thus positively locks bucket 40 in the end hung position until such time as handle 128 is raised to raise pin 122 to the release position. Only then can cylinder 106 be retracted to rotate the bucket from the end hung position to the side hung position. This locking arrangement maintains bucket 40 in the end hung position until the lock is positively and intentionally released. As an alternative to the locking arrangement herein described, the cylinder 106 can be provided with a pilot operated holding valve (not shown) which serves to hold the cylinder rod in the extended condition to maintain the bucket in its end hung position.

It is to be understood that a second bucket identical to the bucket 40 can be installed on the opposite side of the upper boom tip 38 and provided with its own platform rotator identical to that described for bucket 40. If a second bucket is included, the location of the bracket plates 94 and 96 is shifted slightly on the buckets to permit both buckets to be rotated to the end hung position without colliding or otherwise interfering with one another. Then, the two buckets cooperate to form a simulation of a two-man end hung bucket. Both buckets can be rotated to the side to permit use of the material handling jib 144.

Although in the embodiment shown and described herein, the beam 92 extends beyond the upper boom tip, this is not always necessary; it is only necessary that the vertical axis of bucket rotation (pin 100) be located forwardly far enough to allow the bucket to clear the boom tip and jib bracket 146 upon rotation of the bucket to the end hung position. Accordingly, successful practice of the invention requires only that the vertical axis of platform rotation be offset from the horizontal platform pin 78 in a direction away from the lower end of the upper boom.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a vehicle mounted aerial device of the type having a boom assembly mounted for rotation on the vehicle, a generally horizontal platform pin supported on the boom assembly to turn relative thereto about an axis coinciding with the axis of the platform pin, a working platform, and leveling means for maintaining the platform pin in a substantially constant orientation relative to the ground at all positions of the boom assembly, the improvement comprising:

a mounting frame for the platform rigidly connected with the platform pin to turn therewith about the platform pin axis;

means for mounting the platform on said frame in a manner permitting the platform to rotate relative to the frame about a generally vertical rotational axis displaced from the axis of the platform pin, said mounting means permitting the platform to rotate about said rotational axis between a first position to one side of the boom assembly and a second position beyond the end of the boom assembly;

rotation drive means for effecting rotation of the platform between the first and second positions;

stop means for stopping the platform in a preselected rotative position between the first and second positions as the platform is being rotated from the first position toward the second position; and means for overriding said stop means to permit the platform to be rotated from said preselected rotative position to the second position.

2. The improvement of claim 1, wherein said overriding means is accessible from the platform.

3. A vehicle mounted aerial device comprising:

a boom assembly mounted on the vehicle for rotation about one end and having an upper boom tip at the opposite end;

a generally horizontal platform pin supported on said upper boom tip for turning movement about a horizontal axis coinciding with the axis of the platform pin;

a working platform;

a mounting frame for said platform rigidly connected with said platform pin to turn therewith about said horizontal axis;

means for mounting said platform on said frame in a manner permitting the platform to rotate between first and second positions about a generally vertical rotational axis displaced from said horizontal axis in a direction away from said one end of the boom assembly to permit the platform to be situated to one side of the upper boom tip in the first position and beyond the end of the upper boom tip in the second position;

leveling means for maintaining the platform pin in a preselected orientation relative to the ground to maintain the platform in a preselected orientation relative to the ground;

rotation drive means for effecting rotation of said rotational axis between the first and second positions;

stop means for stopping said platform in a preselected rotative position between said first and second positions as the platform is being rotated from the first position toward the second position; and means for disabling said stop means to permit rotation of said platform from said preselected rotative position to said second position.

4. In a vehicle mounted aerial device of the type having a boom assembly mounted for rotation on the vehicle, a generally horizontal platform pin supported on the boom assembly to turn relative thereto about an axis coinciding with the axis of the platform pin, a working platform, and leveling means for maintaining the platform pin in a substantially constant orientation relative to the ground at all positions of the boom assembly, the improvement comprising:

a mounting frame for the platform rigidly conncted with the platform pin to turn therewith about the platform pin axis;

means for mounting the platform on said frame in a manner permitting the platform to rotate relative to the frame about a generally vertical rotational axis displaced from the axis of the platform pin and displaced from alignment with the longitudinal axis of the boom assembly, said mounting means permitting the platform to rotate about said rotational axis between a first position to one side of the boom assembly and a second position beyond the end of the boom assembly; and rotation drive means for effecting rotation of the platform between the firs and second positions.

5. The improvement of claim 4, wherein said mounting means permits the platform to rotate through an arc of approximately 90° between the first and second positions.

6. The improvement of claim 5, wherein the platform has a length dimension and a width dimension less than the length dimension, said length dimension being oriented generally perpendicular to the platform pin in the first position and generally parallel to the platform pin in the second position.

7. The improvement of claim 4, including releaseable means for locking the platform in said second position.

8. The improvement of claim 4, wherein said rotation drive means includes a power cylinder having one end connected to said mounting frame and an opposite end connected to the platform at a location displaced from said rotational axis, whereby extension and retraction of said power cylinder effects rotation of the platform about said rotational axis.

9. A vehicle mounted aerial device comprising:

a boom assembly mounted on the vehicle for rotation about one end and having an upper boom terminating in an upper boom tip at the opposite end;

a generally horizontal platform pin supported on said upper boom tip for turning movement about a horizontal axis coinciding with the axis of the platform pin;

a working platform;

a mounting frame for said platform rigidly connected with said platform pin to turn therewith about said horizontal axis;

means for mounting said platform on said frame in a manner permitting the platform to rotate between first and second position about a generally vertical rotational axis displaced from said horizontal axis in a direction away from said one end of the boom assembly to permit the platform to be situated to one side of the upper boom tip in the first position and beyond the end of the upper boom tip in the second position, said vertical rotational axis also being out of alignment with the longitudinal axis of said upper boom;

leveling means for maintaining the platform pin in a preselected orientation relative to the ground to maintain the platform in a preselected orientation relative to the ground; and rotation drive means for effecting rotation of said platform about said rotational axis between the first and second positions.

10. The invention of claim 9, wherein said platform is rotatable through an arc of approximately 90° between the first and second positions.

11. The invention of claim 10, wherein said platform has a length dimension and a width dimension less than the length dimension, said platform being oriented with its length dimension generally perpendicular to the platform pin in the first position and generally parallel to the platform pin in the second position.

12. The invention of claim 9, including releaseable means for locking said platform in the second position.

13. The invention of claim 9, wherein said mounting frame includes a rigid horizontal beam having one end portion rigidly connected with said platform pin and an opposite end portion on which said platform is mounted for rotation about said rotational axis.

14. A rotating mechanism for a platform carried on a rotatable boom assembly of a vehicle mounted aerial device, said mechanism comprising:

a generally horizontal platform pin supported on an upper tip portion of the boom assembly to turn about a horizontal axis coinciding with the axis of the platform pin;

a rigid beam having one end portion connected with said platform pin to turn therewith about said horizontal axis, said beam having an opposite end portion offset from said platform pin in a direction away from the vehicle mounted end of the boom assembly;

means establishing a substantially vertical rotational axis on said opposite end portion of said beam at a location displaced from said horizontal axis;

means mounting said platform on the beam for rotation about said rotational axis between a first position wherein the platform is alongside said upper tip portion of the boom assembly and a second position wherein the platform is beyond the end of said upper tip portion;

leveling means acting on said platform pin in a manner to maintain the platform in a preselected orientation relative to the ground at all positions of the boom assembly;

means for rotating the platform between the first and second positions;

stop means for stopping said platform in a preselected rotative position between said first and second positions as the platform is being rotated from the first position toward the second position; and means for disabling said stop means to permit rotation of said platform from said preselected rotative position to said second position.

15. A rotating mechanism for a platform carried on a rotatable boom assembly of a vehicle mounted aerial device, said mechanism comprising:

a generally horizontal platform pin supported on an upper tip portion of the boom assembly to turn about a horizontal axis coinciding with the axis of the platform pin;

a rigid beam having one end portion connected with said platform pin to turn therewith about said horizontal axis, said beam having an opposite end portion offset from said platform pin in a direction away from the vehicle mounted end of the boom assembly;

means establishing a substantially vertical rotational axis on said opposite end portion of said beam at a location displaced from said horizontal axis and displaced from alignment with the boom assembly;

means mounting said platform on the beam for rotation about said rotational axis between a first position wherein the platform is alongside said upper tip portion of the boom assembly and a second position wherein the platform is beyond the end of said upper tip portion;

leveling means acting on said platform pin in a manner to maintain the platform in a preselected orientation relative to the ground at all positions of the boom assembly; and means for rotating the platform between the first and second positions.

16. The invention of claim 15, including releaseable means for locking said platform in the second position.

17. The invention of claim 16, wherein said releaseable means includes:

a locking pin on the platform at a location offset from said rotational axis;

an opening on said beam having a size and location to receive said locking pin when the platform is rotated to the second position; and yieldable means for urging said locking pin in a direction to remain in said opening to lock the platform in the second position thereof.

18. The invention of claim 15, wherein said platform has a length dimension and a width dimension less than the length dimension, said platform being oriented in the first position with the length dimension thereof oriented generally perpendicular to said platform pin and in the second position with the length dimension thereof oriented generally parallel with said platform pin.

19. The invention of claim 15, wherein said rotating means includes an extensible and retractable power cylinder having one end pivotally connected with said beam adjacent said one end portion thereof and an opposite end pivotally connected with said platform at a location offset from said rotational axis, whereby extension and retraction of said power cylinder effects rotation of said platform about said rotational axis.

20. The invention of claim 15, including:

a locking pin carried on the platform at a location offset from said rotational axis, said locking pin being axially movable between a locking position and a release position;

a keeper on said beam having first and second openings therein at locations to receive said locking pin when same is in the locking positions, said locking pin being displaced from said openings in the release position;

yieldable means for urging said locking pin toward the locking position;

said first opening being located to receive said locking pin when the platform has been rotated to a preselected position between the first and second positions, whereby engagement of said locking pin in said first opening prevents rotation of the platform from said preselected position to said second position while the locking pin is in its locking position;

said second opening being located to receive the locking pin when the platform is in the second position, thereby locking the platform in the second position while the locking pin is in its locking position; and means accessible from the platform for effecting movement of the locking pin from its locking position to its release position, thereby permitting withdrawal of said locking pin from said first and second openings.

21. A rotating mechanism for a platform carried on a rotatable boom assembly of a vehicle mounted aerial device, said mechanism comprising:

a generally horizontal platform pin supported on an upper tip portion of the boom assembly to turn about a horizontal axis coinciding with the axis of the platform pin;

a rigid beam having one end portion connected with said platform pin to turn therewith about said horizontal axis, said beam having an opposite end portion offset from said platform pin in a direction away from the vehicle mounted end of the boom assembly;

means establishing a substantially vertical rotational axis on said opposite end portion of said beam at a location displaced from said horizontal axis;

means mounting said platform on the beam for rotation about said rotational axis between a first position wherein the platform is alongside said upper tip portion of the boom assembly and a second position wherein the platform is beyond the end of said upper tip portion;

leveling means acting on said platform pin in a manner to maintain the platform in a preselected orientation relative to the ground at all positions of the boom assembly;

means for rotating the platform between the first and second positions;

a locking pin carried on the platform at a location offset from said rotational axis, said locking pin being axially movable between a locking position and a release position;

a keeper on said beam having first and second openings therein at locations to receive said locking pin when same is in the locking positions, said locking pin being displaced from said openings in the release position;

yieldable means for urging said locking pin toward the locking position;

said first opening being located to receive said locking pin when the platform has been rotated to a preselected position between the first and second positions, whereby engagement of said locking pin in said first opening prevents rotation of the platform from said preselected position to said second position while the locking pin is in its locking position;

said second opening located to receive the locking pin when the platform is in the second position, thereby locking the platform in the second position while the locking pin is in its locking position; and means accessible from the platform for effecting movement of the locking pin from its locking position to its release position, thereby permitting withdrawal of said locking pin from said first and second openings.

* * * * *